US010530046B2

(12) United States Patent
Nishioka et al.

(10) Patent No.: US 10,530,046 B2
(45) Date of Patent: Jan. 7, 2020

(54) ANTENNA DEVICE AND ARRAY ANTENNA DEVICE

(71) Applicant: Mitsubishi Electric Corporation, Tokyo (JP)

(72) Inventors: Yasuhiro Nishioka, Tokyo (JP); Tai Tanaka, Tokyo (JP); Yoshio Inasawa, Tokyo (JP); Hayato Ogino, Tokyo (JP); Yuichiro Fukuma, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 63 days.

(21) Appl. No.: 15/776,506

(22) PCT Filed: Jan. 20, 2016

(86) PCT No.: PCT/JP2016/051551

§ 371 (c)(1),
(2) Date: May 16, 2018

(87) PCT Pub. No.: WO2017/126054

PCT Pub. Date: Jul. 27, 2017

(65) Prior Publication Data

US 2018/0351241 A1 Dec. 6, 2018

(51) Int. Cl.

| | |
|---|---|
| ***H01Q 1/26*** | (2006.01) |
| ***H01Q 1/36*** | (2006.01) |
| ***H01Q 1/24*** | (2006.01) |
| ***H01Q 21/00*** | (2006.01) |

(52) U.S. Cl.

CPC ..... *H01Q 1/366* (2013.01); *H01Q 1/247* (2013.01); *H01Q 21/00* (2013.01)

(58) Field of Classification Search

CPC ..... H01Q 1/366; H01Q 1/247; H01Q 21/00
See application file for complete search history.

(56) References Cited

U.S. PATENT DOCUMENTS

| | | | | |
|---|---|---|---|---|
| 6,407,719 | B1 | 6/2002 | Ohira et al. | |
| 10,181,639 | B2 * | 1/2019 | Naito | H01Q 1/26 |
| 2002/0105474 | A1 | 8/2002 | Kitamura et al. | |
| 2017/0179587 | A1 * | 6/2017 | Cohen | H01Q 1/366 |

FOREIGN PATENT DOCUMENTS

| | | | |
|---|---|---|---|
| EP | 1 471 601 | A1 | 10/2004 |
| JP | 2001-298201 | A | 10/2001 |
| JP | 2002-232313 | A | 8/2002 |
| JP | 2004-328128 | A | 11/2004 |

OTHER PUBLICATIONS

Linardakis et al., "Small-Signal Impedance of a Radio Frequency Plasma Capacitor," IEEE Microwave and Wireless Components Letters, vol. 17, No. 11, Nov. 2007, pp. 763-765.

* cited by examiner

*Primary Examiner* — Dieu Hien T Duong
(74) *Attorney, Agent, or Firm* — Birch, Stewart, Kolasch & Birch, LLP.

(57) ABSTRACT

A sealed case (6) includes a first electrode (4) and a second electrode (5). The maximum size of each of these electrodes and a distance between them are equal to or smaller than one tenth the wavelength of a signal of interest. The sealed case (6) is configured such that the internal gas becomes a plasma state. The second electrode (5) is connected to a first conductor (1), and the first electrode (4) is connected to a second conductor (2) disposed to be perpendicular to the first conductor (1).

10 Claims, 6 Drawing Sheets

ANTENNA DEVICE AND ARRAY ANTENNA DEVICE

TECHNICAL FIELD

The present invention relates to an antenna device loaded with a variable capacitive element using plasma and whose radiation pattern is variable, an antenna device whose operation frequency is variable, and an array antenna device in which such antenna devices are used.

BACKGROUND ART

Variable capacitive diodes (also referred to as, for example, varactor (Variable Reactor) diodes or varicap (Variable Capacitor)) are often used for switching of a radiation pattern of an antenna (radiation directivities, or simply, directivities) or its operation frequency (the frequency at which the antenna works). As such an antenna, for example, an antenna is known that includes a non-excitation element (also referred to as a passive element or a parasitic element) in the vicinity of a driven element (which is directly connected with a feeder path) to control the directivities by changing the value of the reverse bias applied to the variable capacitive diode loaded on the non-excitation element.

A technique is also known in which a variable capacitive diode is used for a matching circuit of a monopole antenna on a ground plate and the value of the reverse bias applied to the variable capacitive diode is changed to change the matching frequency between the antenna and the feeder path, namely, to change the operation frequency of the antenna (see Patent Literature 1, for example).

CITATION LIST

[PLT 1]
Japanese Unexamined Patent Application Publication No. 2002-232313

SUMMARY OF INVENTION

Technical Problem

In the antenna device described in Patent Literature 1, if the power of a high frequency (RF) wave used in radar or communication is low, the RF voltage superposing the DC reverse bias is low, resulting in desired operation without difficulties. Therefore, this type of antenna device is often used as a receiver antenna. However, if the RF power treated by the antenna device is higher, the RF voltage superposing the DC reverse bias is also higher, and thus, the RF voltage becomes too high for the variable capacitive element to operate normally. As a result, the variable capacitive element in the antenna device cannot operate as desired so that it is difficult to perform switching of the directivity of an antenna or a matching circuit in the antenna using the variable capacitive diode.

The present invention has been made in view of the above problem, and an object of the present invention is to provide an antenna device that can surely switch the directivity or operation frequency.

Solution to Problem

The antenna device according to the present invention includes: a first conductor; a second conductor disposed to be perpendicular to the first conductor; a sealed case comprising a first electrode and a second electrode, the maximum size of each of the first and second electrodes and a distance between the first and second electrodes being equal to or smaller than one tenth the wavelength of a signal of interest, the sealed case containing rare gas; and a power source applying variable voltage to the first and second electrodes to ionize the rare gas in the sealed case into a plasma state. The first electrode is connected to the second conductor, and the second electrode is connected to the first conductor.

Advantageous Effects of Invention

The antenna device according to the present invention uses a variable capacitive element using plasma as an element of a variable matching circuit. Due to such a configuration, switching of the operation frequency can be surely performed.

DESCRIPTION OF EMBODIMENTS

Some embodiments of the present invention will be described in more detail for explaining the present invention with reference to the accompanying drawings.

Embodiment 1

An antenna structure loaded with a variable capacitive element using plasma will be described. The relative permittivity $\varepsilon_r$ of collisionless and low-temperature plasma is represented by the following Formula (1):

$$\varepsilon_r = 1 - \frac{\omega_p^2}{\omega^2} \tag{1}$$

Figure 1:
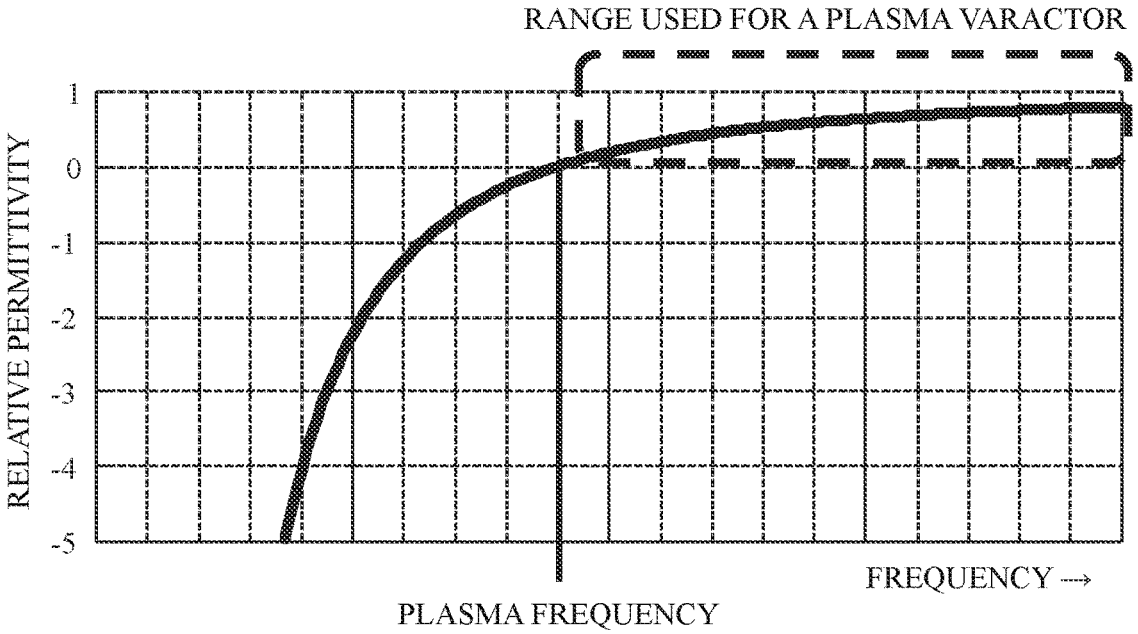
FIG. 1 is an explanatory graph illustrating characteristics between the relative permittivity and the frequency of plasma.

$\omega_p = (n_e e^2/m_e \varepsilon_0)^{1/2}$: plasma angular frequency.

where $n_e$ represents the electron density, $m_e$ the mass of an electron, e the charge of the electron, $\varepsilon_0$ the vacuum permittivity, and $\omega$ the angular frequency of the electromagnetic wave. Each of these parameters other than the electron density $n_e$ is a constant. In FIG. 1, Formula (1) is represented by a graph, where the horizontal axis indicates the frequency of a radio wave and the vertical axis indicates the relative permittivity of plasma. By changing the voltage and current applied to electrodes, the plasma frequency $f_p=\omega_p/2\pi$ can be changed, and as a result, the relative permittivity $\varepsilon_r$ of plasma can be dynamically controlled. On the other hand, the capacitance C of a capacitor is represented by:

$$C = \frac{\varepsilon_0 \varepsilon_r S}{d} \tag{2}$$

where S represents the area of each of the two conductive plates used as electrodes, and d the distance between the two conductive plates (the distance between the electrodes).

Thus, by disposing a plasma medium between the two conductive plates (electrodes) and changing the voltage and current applied between the electrodes, it is possible to change the electrostatic capacitance between the electrodes. However, if the size of the conductive plates (electrodes) is not small enough relative to the radio wavelength used for communication or radar, for example, half of the radio wavelength, resonance phenomenon occurs in the frequency of the radio waves, thus the conductive plates no longer operate as a capacitor. It should be noted that, in this explanation, the size of an electrode refers to the size of the maximum length part of the electrode plate regardless of its shape and will be hereinafter referred to as the maximum size of the electrode.

Figure 2:
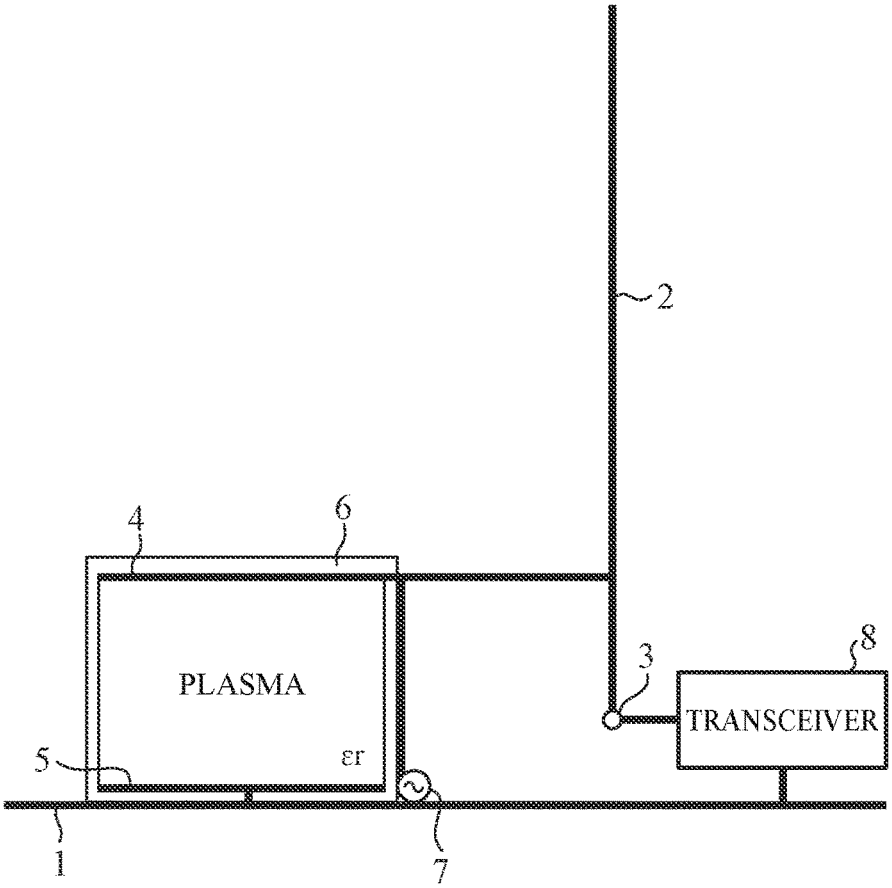
FIG. 2 is a block diagram of an antenna device according to Embodiment 1 of the present invention.

FIG. 2 is a block diagram illustrating an antenna device according to Embodiment 1.

The antenna device according to Embodiment 1 includes a first conductor 1, a second conductor 2, an input/output terminal 3, a first electrode 4, a second electrode 5, a sealed case 6, a high-voltage power source 7, and a transceiver 8. The first conductor 1 is a ground plate as an antenna device. The second conductor 2 is an antenna radiation conductor disposed to be perpendicular to the first conductor 1 and functions as a driven element. The input/output terminal 3 functions as a terminal for supplying radio waves used in radar or communication to the first conductor 1 and the second conductor 2 during a transmission operation, and functions as a terminal for outputting signals received by the first conductor 1 and the second conductor 2 to the outside during a reception operation. The first electrode 4 and the second electrode 5 are disposed to face each other in the sealed case 6 and are formed such that the interval between them and the maximum size of each of them are equal to or smaller than one tenth the wavelength of the radio wave to be used. In the sealed case 6, rare gas which is easily ionized, for example, helium, neon, or argon is contained. The high-voltage power source 7 applies high voltage to the first electrode 4 and the second electrode 5 and ionizes the gas contained in the sealed case 6 into a plasma state. In the drawing, the high-voltage power source 7 is represented as an AC power source. Instead, a DC power source may be used. The transceiver 8 is connected between the input/output terminal 3 and the second electrode 5. The transceiver 8 is a device for transmitting a signal during the transmission operation of the antenna device and receiving a signal through the input/output terminal 3 during the reception operation of the antenna device.

The operation of the antenna device according to Embodiment 1 will now be explained.

During the transmission operation, the radio wave supplied from the transceiver 8 through the input/output terminal 3 is radiated into the air from the second conductor 2. Since the second electrode 5 is connected to the first conductor being a ground plate through an appropriate conductor, the first electrode 4 and the second electrode 5 are connected to the input/output terminal 3 in parallel and thus operate as a capacitor. In order to operate as a capacitor, the maximum size of the first electrode 4 and the second electrode 5 must be small enough relative to the radio wavelength used in radar or communication. The interval (distance) between the first electrode 4 and the second electrode 5 must also be small enough relative to the radio wavelength. The size and interval are preferably equal to or smaller than one tenth the wavelength. The sealed case 6 contains rare gas which is easily ionized, and high voltage of equal to or higher than several kilovolts is applied between the first electrode 4 and the second electrode 5 by the high-voltage power source 7. The gas contained in the sealed case 6 can be thereby ionized to be in the plasma state. As described before, the electrostatic capacitance of a capacitor is proportional to the permittivity of the medium between the electrodes, and thus the permittivity of the plasma can be controlled by the applied voltage between the electrodes. Hence, according to the above configuration, an antenna with variable operation frequency can be obtained.

In a reception operation, a signal at the operation frequency determined in accordance with the voltage applied between the first electrode 4 and the second electrode 5 from the high-voltage power source 7 is received from the second conductor 2 and is received by the transceiver 8 through the input/output terminal 3.

In this manner, in Embodiment 1, since a variable capacitive element using plasma is adopted, an operation desired as an antenna with variable operation frequency can be achieved. Namely, the total voltage V applied to the variable capacitive element is the sum of the RF voltage (Vrf) used in communication or radar and the other externally applied voltage (V0): V=V0+Vrf. Thus, if V0>>Vrf, the variation in V is very small, and an operation desired as a variable frequency antenna can be thereby achieved. On the other hand, when a conventional variable capacitive diode is used, because of the relation V0<<Vrf, the variation in V is large so that a desired operation cannot be achieved. Thus, the antenna device according to the present embodiment can provide a solution to such problems.

As describe above, the antenna device according to Embodiment 1 includes: a first conductor; a second conductor disposed to be perpendicular to the first conductor; a sealed case comprising a first electrode and a second electrode, the maximum size of each of the first and second electrodes and a distance between the first and second electrodes being equal to or smaller than one tenth the wavelength of a signal of interest, the sealed case containing rare gas; and a power source applying variable voltage to the first and second electrodes to ionize the rare gas in the sealed case into a plasma state. The first electrode is connected to the second conductor, and the second electrode is connected to the first conductor. As a result, the operation frequency can be surely switched.

Embodiment 2

In Embodiment 2, a high-voltage breaker is provided between the second conductor 2 and the first electrode 4. The high-voltage breaker becomes electrically open at the frequency applied by the high-voltage power source 7.

Figure 3:
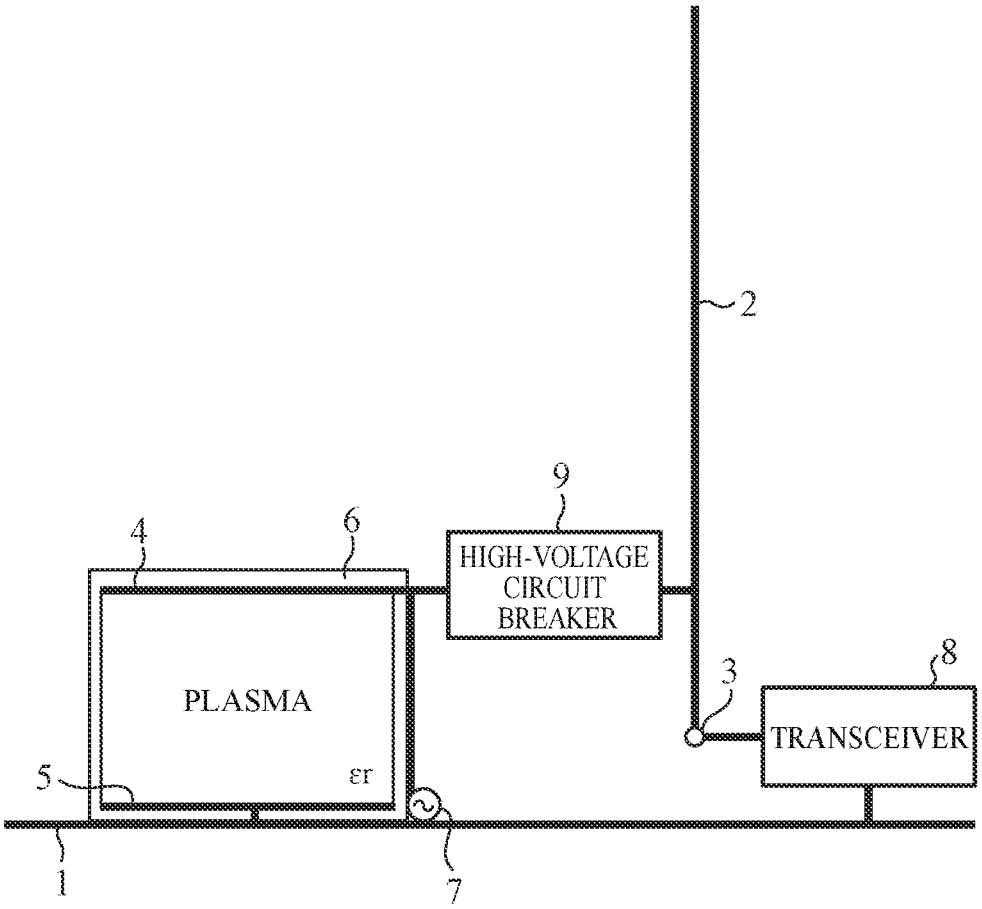
FIG. 3 is a block diagram of an antenna device according to Embodiment 2 of the present invention.

FIG. 3 is a block diagram illustrating an antenna device according to Embodiment 2, in which the antenna device further includes a high-voltage breaker 9 in addition to the configuration of Embodiment 1 illustrated in FIG. 2. Other components in this configuration are the same as those in FIG. 2 so that they are denoted by the same reference numerals and detailed descriptions thereof are omitted. The high-voltage breaker 9 is provided between the first electrode 4 and the second conductor 2, and a capacitor can be used if the high-voltage power source 7 supplies a direct current. Since the impedance of the capacitor is $1/(j\omega C)$, a capacitance C at which the capacitor is supposed to be substantially short-circuited at the frequency of the radio wave used in radar or communication may be selected. Alternatively, the value of the capacitor may be selected such that the high-voltage breaker 9 is also used as a matching circuit for the antenna.

If the high-voltage power source 7 supplies an alternating current, several methods can be employed. If the ratio of the transmission frequency to the frequency of the high-voltage power source 7 is more than several tens, by using a capacitor having an appropriate capacitance value as the high-voltage breaker 9, it is possible for the high-voltage breaker 9 to be electrically open substantially at the frequency of the high-voltage power source 7 and electrically short-circuited substantially at the transmission frequency. On the other hand, if the ratio of the transmission frequency to the frequency of the high-voltage power source 7 is less than several tens, an LC parallel resonance circuit whose resonance frequency is the frequency of the high-voltage power source 7 may be used as the high-voltage breaker 9.

The antenna device configured in such a manner in Embodiment 2 can prevent the voltage applied by the high-voltage power source 7 from being applied to the second conductor 2. Namely, if the high-voltage breaker 9 does not exist between the first electrode 4 and the second conductor 2, the high-voltage from the high-voltage power source 7 is applied to the second conductor 2. Thus, the high-voltage is undesirably applied to the transceiver 8 through the input/output terminal 3. In such a case, there arises a problem, for example, that the operation of the transceiver 8 may be obstructed, or the transceiver 8 may be damaged. On the contrary, in Embodiment 2, the voltage from the high-voltage power source 7 can be blocked at the high-voltage breaker 9 and the above problem can be solved.

As described above, the antenna device according to Embodiment 2 includes a high-voltage breaker between the second conductor and the first electrode. The high-voltage breaker becomes electrically open at the frequency applied by the power source so that decreasing of the performance as the antenna device can be prevented while the effects same to those of Embodiment 1 can also be achieved.

Further, according to the antenna device of Embodiment 2, since a capacitor is used as the high-voltage breaker, the high-voltage breaker can be manufactured at low cost.

Moreover, according to the antenna device of Embodiment 2, since an LC parallel resonance circuit is used as the high-voltage breaker, even when the ratio of the transmission frequency to the frequency of the power source is small, the high-voltage breaker can be configured.

Embodiment 3

In Embodiment 3, in addition to the configuration of Embodiment 2, a high-frequency breaker 10 is provided. The high-frequency breaker 10 is disposed between the high-voltage power source 7 and the first electrode 4 and blocks a signal having a transmission frequency received through the input/output terminal 3.

Figure 4:
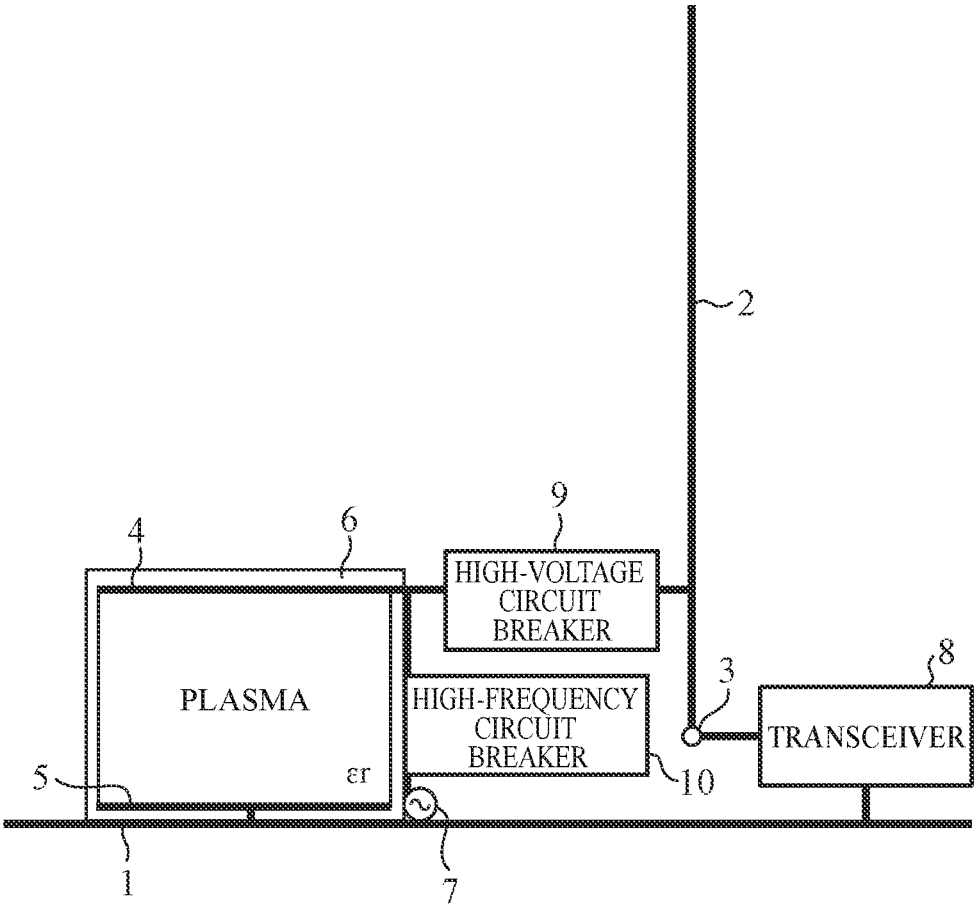
FIG. 4 is a block diagram of an antenna device according to Embodiment 3 of the present invention.

FIG. 4 is a block diagram illustrating an antenna device of Embodiment 3 in which the high-frequency breaker 10 is added to the configuration of Embodiment 2 shown in FIG. 3. The high-frequency breaker 10 is disposed between the high-voltage power source 7 and a connection node of the first electrode 4 and the high-voltage breaker 9. The high-frequency breaker 10 is configured using, for example, an LC parallel resonance circuit whose resonance frequency is the transmission frequency of a signal from the transceiver 8 which is input through the input/output terminal 3. Other components in this configuration are the same as those of Embodiment 2 illustrated in FIG. 3 so that they are denoted by the same reference numerals and the descriptions thereof are omitted.

The antenna device configured in this manner in Embodiment 3 can block a transmission frequency signal input through the input/output terminal 3 and applied to the high-voltage power source 7. Namely, the current of the radio wave supplied from the transceiver 8 may flow into the high-voltage power source 7 through the input/output terminal 3, resulting in deterioration in antenna characteristics. However, in Embodiment 3, since the high-frequency breaker 10 can block such a current flow, the influence on the voltage applied from the high-voltage power source 7 to the first electrode 4 and the second electrode 5 can be eliminated.

In the above Embodiment 3, the high-frequency breaker 10 is added to the configuration of Embodiment 2. Alternatively, the high-frequency breaker 10 may be added to the configuration of Embodiment 1. In other words, only the high-frequency breaker 10 may be added to the configuration of Embodiment 1.

As described above, the antenna device of Embodiment 3 includes a high-frequency breaker between a power source and a first electrode. The high-frequency breaker blocks transmission frequency signals applied to a first conductor and a second conductor. As a result, in addition to the effects of Embodiment 1, the deterioration in performance as an antenna device can be prevented.

Further, the antenna device of Embodiment 3 includes a high-voltage breaker disposed between the second conductor and the first electrode and being electrically open at the frequency applied by the power source; and the high-frequency breaker disposed between the power and the first electrode and blocking a transmission frequency signal to be supplied to the first and second conductors. As a result, in addition to the effects of Embodiment 1, the deterioration in performance as an antenna device can be prevented.

Moreover, in the antenna device of Embodiment 3, an LC parallel resonance circuit is used as the high-frequency breaker. As a result, the high-frequency breaker can be configured at low cost.

Embodiment 4

In the above embodiments, a plasma variable capacitive element is used as an element in a variable matching circuit, and the operation frequency of an antenna (the impedance matching frequency of the antenna and the feeder path) is variable. In the present embodiment, the plasma variable capacitive element is used to switch the radiation directivity of the antenna.

Figure 5:
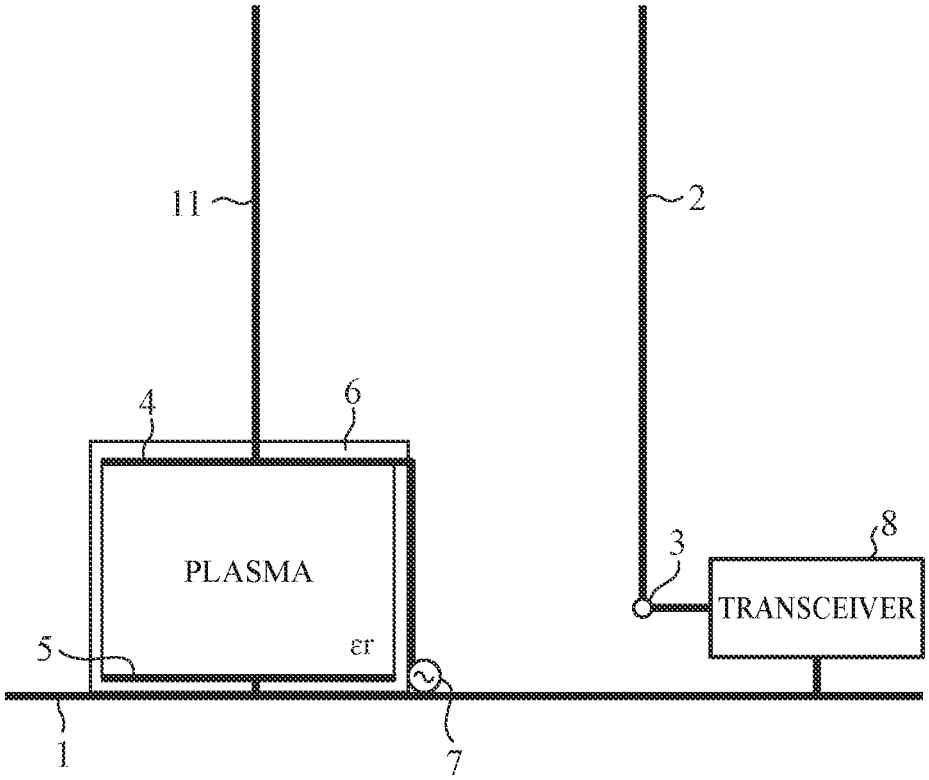
FIG. 5 is a block diagram of an antenna device according to Embodiment 4 of the present invention.

FIG. 5 is a block diagram illustrating an antenna device of Embodiment 4. The structural differences of Embodiment 4 from the embodiments described before are that the antenna device does not include the conductor connecting the first electrode 4 and the second conductor 2, and the first electrode 4 is connected with a third conductor 11. The third conductor 11 is a non-excitation element. Other components in this configuration are the same as those of Embodiment 1 illustrated in FIG. 2 and denoted by the same reference numerals, and they are not described in detail.

Figure 6A:
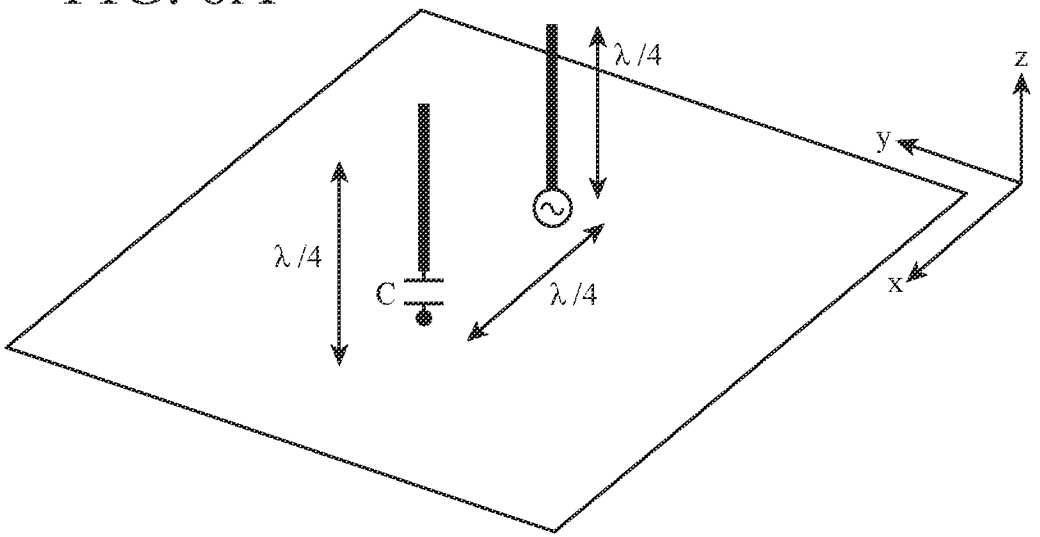
FIG. 6A is a schematic perspective view of the antenna device according to Embodiment 4 of the present invention.
Figure 6B:
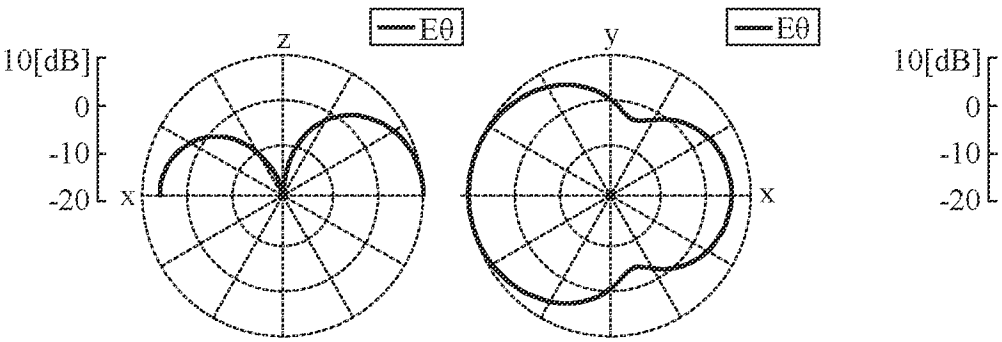
FIG. 6B is an explanatory diagram of the radiation pattern at C=80 pF.
Figure 6C:
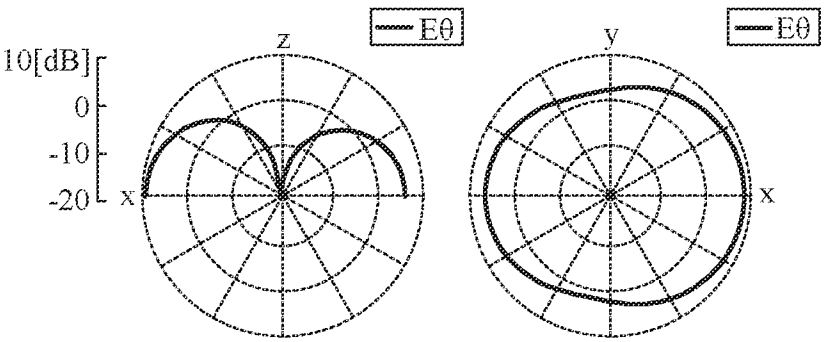
FIG. 6C is an explanatory diagram of the radiation pattern at C=20 pF.

In the antenna device according to Embodiment 4, by appropriately selecting the interval between the second conductor 2 being a driven element and the third conductor 11 being a non-excitation element and appropriately switching the voltage applied from the high-voltage power source 7 to the first electrode 4 and the second electrode 5, the direction of the radio wave based on the transmission signal supplied from the input/output terminal 3 and radiated into the air can be controlled. FIGS. 6A to 6C illustrate, for example, the calculation results of variation in the radiation directivity by means of numerical electromagnetic field analysis method in the FDTD method in the case where the transmission frequency is 100 MHz, and the value of the capacitance formed by the first electrode 4 and the second electrode 5 and the plasma in the sealed case 6 is switched between 80 pF and 20 pF. FIG. 6A is a schematic perspective view of an antenna device. FIG. 6B illustrates the radiation pattern at C=80 pF (Z=−j20Ω). FIG. 6C illustrates the radiation pattern at C=20 pF (Z=−j80Ω). As is apparent from the respective radiation patterns in FIGS. 6B and 6C, it can be understood that the directivity can be largely changed even when the change rate of the capacitance is about 1:4.

As described before, since the value of capacitance is proportional to the relative permittivity of the plasma in the sealed case 6, the radiation directivity of the antenna illustrated in FIG. 5 can be changed by changing the applied voltage by the high-voltage power source 7. It should be noted that the interval (distance) between the second conductor 2 and the third conductor 11 may be any value as long as the value is in a range where the conductors are electromagnetically coupled to each other and the radiation directivity can be changed. The illustrated example indicates the case where the interval is λ/4. Normally, the distance is equal to or less than half of the wavelength of the radio wave radiated into the air.

As explained above, in Embodiment 4, since a variable capacitive element using plasma is adopted, a desired operation as an antenna with switchable radiation directivity can be achieved. In other words, similarly to the case of the operation as a matching circuit, even if the current generated by the radio wave input from the input/output terminal 3 leaks to the side of the high-voltage power source 7, the relation V0>>Vrf is also satisfied in Embodiment 4. The variation in V is thus very small, and the influence of the voltage applied to the variable capacitive element due to the RF voltage can be reduced.

As explained above, the antenna device according to Embodiment 4 includes a first conductor; a second conductor disposed to be perpendicular to the first conductor; a third conductor disposed to be parallel to the second conductor; a sealed case including a first electrode and a second electrode, the maximum size of the first and second electrodes and the distance therebetween being set to be equal to or smaller than one tenth the wavelength of a signal of interest, the case containing rare gas; and a power source applying a voltage to the first and second electrodes to ionize the rare gas in the sealed case into a plasma state and the applied voltage being variable. The third conductor is connected with the first electrode, and the second electrode is connected with the first conductor. Thus, the directivity can be surely switched.

Embodiment 5

In Embodiment 5, a high-frequency breaker 10 is disposed between the high-voltage power source 7 and the first electrode 4. The high-frequency breaker 10 blocks a signal of transmission frequency input through the input/output terminal 3.

Figure 7:
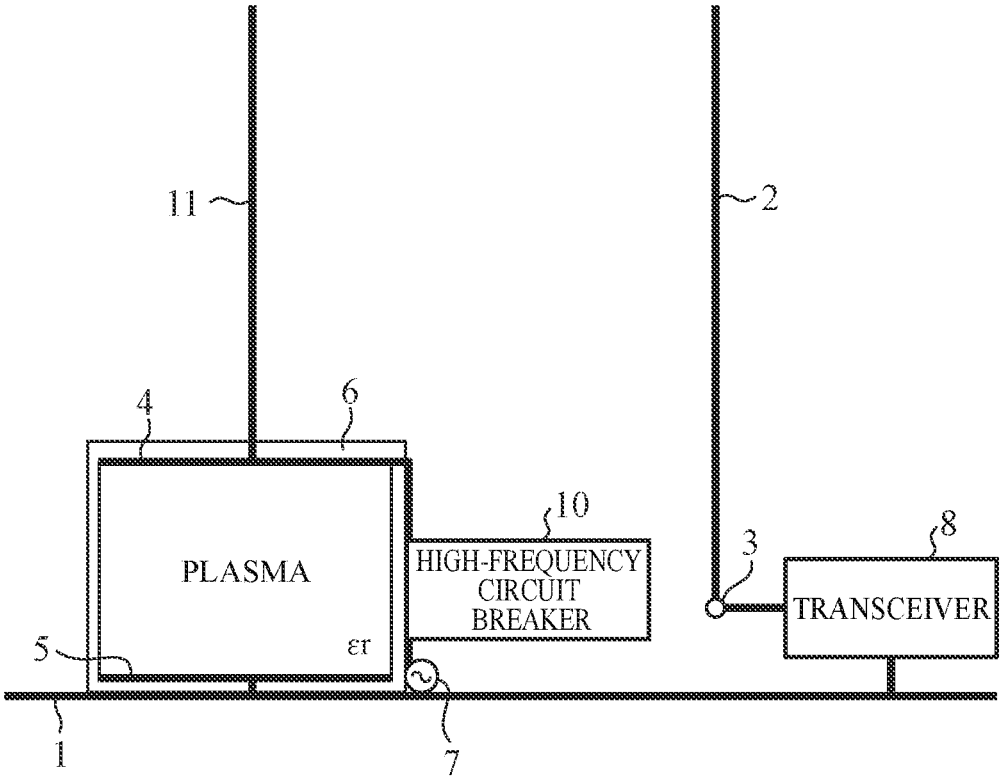
FIG. 7 is a block diagram of an antenna device according to Embodiment 5 of the present invention.

FIG. 7 is a block diagram illustrating an antenna device according to Embodiment 5 where the antenna device further includes the high-frequency breaker 10 in the configuration of Embodiment 4 illustrated in FIG. 5. The high-frequency breaker 10 is disposed between the high-voltage power source 7 and the first electrode 4. The high-frequency breaker 10 includes the LC parallel resonance circuit like Embodiment 3 where its resonance frequency is the frequency of the radio wave transmitted by the transceiver 8. Other components in this configuration, which are the same as those of Embodiment 4 illustrated in FIG. 5 and are denoted by the same reference numerals, are not described in detail.

In the antenna device having such a configuration, the high-frequency breaker 10, which is disposed between the high-voltage power source 7 and the first electrode 4, can block the current of radio wave from the transceiver 8 even if the current leaks to the high-voltage power source 7 through the input/output terminal 3.

As described above, the antenna device according to Embodiment 5 includes a high-frequency breaker disposed between a power source and a first electrode. The high-frequency breaker blocks a signal sent to a first conductor and a second conductor at the transmission frequency, thereby preventing deterioration in antenna performance.

Embodiment 6

Two or more antenna devices described in Embodiments 1 to 5 may be arrayed at predetermined intervals to form an array antenna device using high power. Further, although in each of the above embodiments, an example of a monopole antenna where a first conductor 1 is used as a ground plate has been described, the present invention may be easily applied to a dipole antenna by applying the image theory (the method of mirror images) to the first conductor 1 being a ground plate. Moreover, in the above explanation, the second conductor 2 being a driven element and the third conductor 11 being a non-excitation element are described as linear conductors. Alternatively, the elements may be bent to decrease the heights (height reduction) or may have a linear conductor or a planar conductor parallel to the first conductor 1 on the top (top loading) of the elements to achieve the same effects. In addition, the same effects may also be achieved by disposing two or more non-excitation elements each loaded with a plasma variable capacitive element.

As described above, according to the array antenna device of Embodiment 6, since two or more antenna devices according to any one of Embodiments 1 to 5 are arrayed, switching of the directivity or the operation frequency can be performed surely.

It should be noted that the present invention can include any combination of embodiments, or modifications or omission of any component in the embodiments within the scope of the invention.

INDUSTRIAL APPLICABILITY

As described above, the antenna device and the array antenna device according to the present invention include a variable capacitive element using plasma as a switching means of an element of the variable matching circuit or the radiation directivity of an antenna. The variable capacitive element using plasma is suitable for use in an antenna device having variable radiation patterns or variable operation frequencies.

REFERENCE SIGNS LIST

1 first conductor
2 second conductor
3 input/output terminal
4 first electrode
5 second electrode
6 sealed case
7 high-voltage power source
8 transceiver
9 high-voltage breaker
10 high-frequency breaker
11 third conductor

The invention claimed is:

1. An antenna device comprising:
a first conductor;
a second conductor disposed to be perpendicular to the first conductor;
a sealed case comprising a first electrode and a second electrode, the maximum size of each of the first and second electrodes and a distance between the first and second electrodes being equal to or smaller than one tenth the wavelength of a signal of interest, the sealed case containing rare gas; and
a power source applying variable voltage to the first and second electrodes to ionize the rare gas in the sealed case into a plasma state,
wherein the first electrode is connected to the second conductor, and the second electrode is connected to the first conductor.

2. The antenna device according to claim 1, further comprising a high-voltage breaker disposed between the second conductor and the first electrode and being electrically open at a frequency applied by the power source.

3. The antenna device according to claim 2, wherein the high-voltage breaker is a capacitor.

4. The antenna device according to claim 2, wherein the high-voltage breaker is an LC parallel resonance circuit.

5. The antenna device according to claim 1, further comprising a high-frequency breaker disposed between the power source and the first electrode and blocking a signal of a transmission frequency to be sent to the first and second conductors.

6. The antenna device according to claim 5, wherein the high-frequency breaker is an LC parallel resonance circuit.

7. The antenna device according to claim 1, further comprising:
a high-voltage breaker disposed between the second conductor and the first electrode and being electrically open at a frequency applied by the power source; and
a high-frequency breaker disposed between the power source and the first electrode and blocking a signal of a transmission frequency to be sent to the first and second conductors.

8. An array antenna device comprising an array of two or more antenna devices each of which is the antenna device according to claim 1.

9. An antenna device comprising:
a first conductor;
a second conductor disposed to be perpendicular to the first conductor;
a third conductor disposed to be parallel to the second conductor;
a sealed case comprising a first electrode and a second electrode, the maximum size of each of the first and second electrodes and a distance between the first and second electrodes being equal to or smaller than one tenth the wavelength of a signal of interest, the sealed case containing rare gas; and
a power source applying variable voltage to the first and second electrodes to ionize the rare gas in the sealed case into a plasma state,
wherein the third conductor is connected to the first electrode, and the second electrode is connected to the first conductor.

10. The antenna device according to claim 9, further comprising a high-frequency breaker disposed between the power source and the first electrode and blocking a signal of a transmission frequency to be sent to the first and second conductors.

* * * * *